United States Patent [19]

Siemers et al.

[11] Patent Number: 4,603,568

[45] Date of Patent: Aug. 5, 1986

[54] METHOD OF FABRICATING BIMETAL VARIABLE EXHAUST NOZZLE FLAPS AND SEALS

[75] Inventors: Paul A. Siemers, Clifton Park; Melvin R. Jackson, Schenectady; Stephen F. Rutkowski, Duanesburg, all of N.Y.

[73] Assignee: General Electric Company, Schenectady, N.Y.

[21] Appl. No.: 739,345

[22] Filed: May 30, 1985

[51] Int. Cl.[4] ..... B21D 22/00; B21D 31/00; B21D 53/92

[52] U.S. Cl. ..... 72/47; 72/700

[58] Field of Search ..... 29/527.2, 527.4; 72/46, 72/47, 700; 427/34, 423

[56] References Cited

U.S. PATENT DOCUMENTS 2,858,603 11/1958 Herrmann ..... 72/46 X 3,310,870 3/1967 Parikh et al. ..... 29/527.2 X 3,445,909 5/1969 Beebe ..... 29/527.2 X 3,900,639 8/1975 Lauterbach ..... 427/34

FOREIGN PATENT DOCUMENTS 182985 10/1984 Japan ..... 427/423

2080147 2/1982 United Kingdom ..... 427/34

*Primary Examiner*—E. Michael Combs

*Attorney, Agent, or Firm*—Paul E. Rochford; James C. Davis, Jr.; Paul R. Webb, II

[57] ABSTRACT

A method of forming a generally planar part for a jet engine is provided. The part is adapted for withstanding high thermal stress but not high mechanical stress. A preformed strip of a superalloy is mounted around a drum shaped mandrel. A low pressure plasma deposit of a different superalloy is formed on the preformed strip. The strip is demounted and mechanically straightened.

9 Claims, 6 Drawing Figures

METHOD OF FABRICATING BIMETAL VARIABLE EXHAUST NOZZLE FLAPS AND SEALS

BACKGROUND OF THE INVENTION

The present invention relates generally to the fabrication of components for jet engines. More specifically, it relates to the fabrication of seals and flaps for use in jet engines at elevated temperatures in controlling flow of high temperature gas through the engine.

It is known that some parts of jet engines are subjected to high stress during engine startup or operation. Other parts of the jet engines are subjected to high temperature but are not subjected to high stress during either the startup or steady state operation of the engine. The mode of failure of components of jet engines such as flaps, seals, vanes, and the like, relates both to the material of which the component is composed and also the method of fabrication. The failure of seals and flaps is generally described in terms of thermal fatigue cracking, with degradation of performance related to edge distortion allowing cold air leakage.

In accordance with one mode of practice of the present invention, the performance of engine components may be improved by using combinations of materials and fabrication techniques which permit novel structures to be formed conveniently and economically.

It is highly desirable in the formation of components for jet engines to keep the weight and, accordingly, the bulk of the article at a level whichis sufficient to accomplish the task for which the part was prepared, over an extended useful life, but at the same time to minimize the weight of the part used in the jet engine. For this reason, generally it is desirable to have planar shaped parts, such as flaps and seals which have a minimum weight which permits the part to effectively accomplish its purpose over an extended useful life.

Parts which are employed in jet engines are generally fabricated of the so-called superalloys. These are alloys which resist softening and deformation at elevated use temperature. Temperatures of above 1000° C. are involved in jet engine operation.

In some cases, it is desirable to have the planar parts made up of more than a single metal, as for example a bimetal structure in which two coextensive sheets are sandwiched together. This could be because different functional requirements are presented in respect to one face of the sheet relative to the other. Such requirements may be an ability of one face of the bimetal structure to withstand oxidation, for example.

A strong integral bond must exist between the two layers where two different metals are employed.

However, although two different metals are used in the formation of such sheet, the thickness of the sheet must, nevertheless, be minimized consistent with the functional restraint and requirements of the sheet in its application as a seal or flap. A prior art structure as used in jet engines as, for example, in a variable exhaust nozzle seal of a jet engine is a seal of 0.040" of wrought René 41 sheet metal.

BRIEF STATEMENT OF THE INVENTION

It is, accordingly, one object of the present invention to provide a method of fabricating a generally planar component of a jet engine from a superalloy.

Another object is to provide a thin and low bulk and low weight generally planar component of a jet engine conveniently and economically.

Another object is to provide a method for forming variable exhaust nozzle flaps and seals for jet engines of low weight and bulk.

Another object is to provide a method of fabricating bimetal vaiable exhaust nozzle flaps and seals.

Another object is to provide a lightweight strong bimetal variable exhaust nozzle flap and/or seal.

Other objects will be in part apparent and in part pointed out in the description which follows.

In one of its broader aspects, objects of the present invention can be achieved by first providing a preformed sheet of a superalloy material such as René 41. Next, the sheet is coiled up into a tube.

The coiled sheet is then plasma sprayed on its external surface to deposit a layer of a superalloy onto the surface and to bond it firmly to the surface of the coiled sheet. The sheet is then uncoiled with its superalloy deposit and the sheet is worked so as to give it a generally planar form. Such working may be by reverse rolling.

BRIEF DESCRIPTION OF THE DRAWINGS

The description of the invention which follows will be better understood by reference to the accompanying drawings in which.

DETAILED DESCRIPTION OF THE INVENTION

Figure 1:
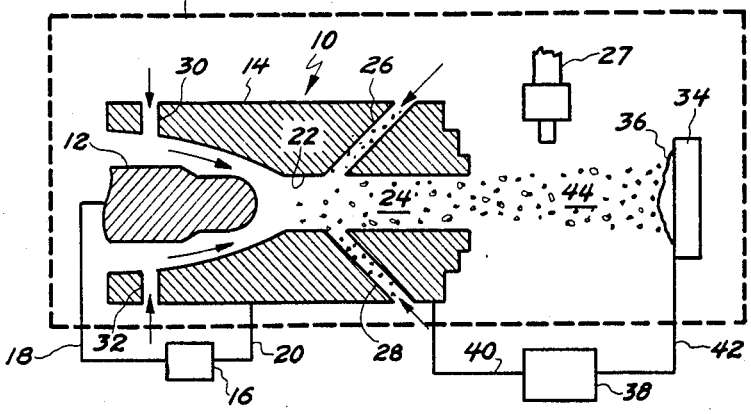
FIG. 1 is a schematic illustration of a low pressure plasma deposition apparatus.

A plasma spray gun adapted for throughput of powder is shown schematically in FIG. 1. The gun has a central cathode 12 which is spaced from an annular anode 14. A working voltage is established between the anode and cathode by a power supply 16 connected respectively to the cathode and anode by conductors 18 and 20. The anode has a central aperture 22 through which a stream of particles shown schematically at 24 may be passed from a source not shown. Optionally the supply of powder in the conventional manner as illustrated at 24 may be omitted. Alternatively powder may be supplied in part as shown and in part externally by means of a powder injector 27 as illustrated in FIG. 1. For the internal powder supply mode the particles may be supplied to the aperture 22 through the powder supply ports 26 and 28 spaced around the anode 14.

A flow of gas is introduced through the ports 30 and 32. The gas passes through the annular space between cathode 12 and anode 14 partly because the gun and target 34 are housed in a low pressure chamber such as 50 as described with reference to FIG. 2. Low pressure enclosure 49 is shown in phantom in FIG. 1 as a dashed line box. The gas is introduced through port 30 and 32 from a source not shown and through conduits not shown. The flow of gas through the annular space between the cathode and anode permits a plasma arc to be established based on the imposition of a suitable arc voltage between the anode and cathode. The sweep of the gas through the annular clearance and through the orifice 24 carries any particles introduced into the orifice along ports 26 and 28 from the orifice and toward a target 34 spaced from the arc plasma spray gun 10. A deposit of material 36 is formed on the target 34. Target 34 serves as a substrate for the layer of deposited material 36.

A suitable power supply 38 may be provided to maintain a voltage as desired between gun 10 and target 34 and to impose on the target a desired change in voltage as may be suitable for operation of the gun 10 and deposit of a desired layer 36. Conductors 40 and 42 connect the power source 38 to the gun 10 and target 34, respectively. While the plasma arc is established between the anode and cathode a very high temperature of the order of 10,000° to 20,000° C. is generated and the energy of this plasma is sufficient to cause a fusion of particles of a suitable diameter introduced into and carried from orifice 24. The molten particles are carried on the plasma jet sprayed from the gun 10 to target 34 in the stream 44 as illustrated.

Where a deposit is made with the low pressure plasma technique using a plasma gun such as 10 onto a relatively large surface such as 34 the surface itself is preferably heated. The heating may be by means of the heat from the plasma gun itself or may be from an independent source. Where a single gun is employed of about 80 kilowatt plasma spray energy the maximum area of a sample which can be maintained at about 900° C. is about 1000 sq. cm. 1000 sq. cm. is contained within a generally circular area of about 36 centimeters diameter. An external supply of powder may be made through injector 27 of FIG. 1 from a source of gas and powder not shown. The design and operation of the external injector 27 and its low pressure environment is described more fully in copending application Ser. No. 664,460, filed Oct. 24, 1984, the text of which is incorporated herein by reference.

Figure 2:
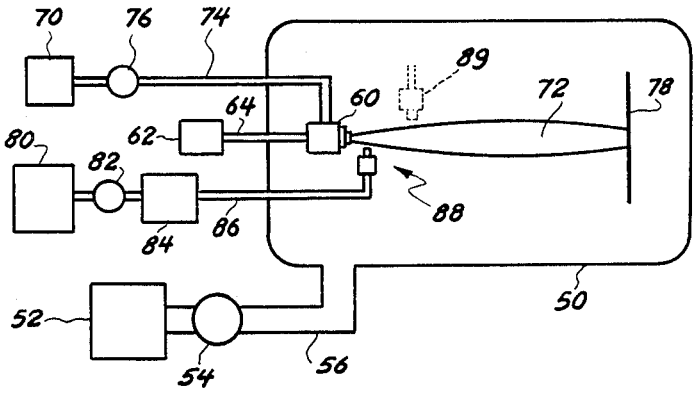
FIG. 2 is a schematic illustration of a similar apparatus employing injection nozzles.

Referring now to FIG. 2 a low pressure plasma deposition apparatus is schematically illustrated. The low pressure is established within the chamber 50 by the action of pump 52 acting through valve 54 and evacuation line 56. A pressure of approximately 60 torr is preferably maintained in the low pressure plasma deposition chamber.

A plasma gun 60 adapted for external powder feed is mounted within the chamber 50 by means not shown. Power source 62 supplies plasma forming power to the gun 60 through the line 64 extending through the wall of chamber 50 and insulated therefrom. A plasma forming gas is supplied to gun 60 through lines 74 through valve 76 from gas supply source 70. The plasma 72 is illustrated in the figure as a plume 72 extending between gun 60 and receiving surface 78.

Receiving surface 78 is mounted within the chamber 50 also by means not shown.

A gas supply 80 is adapted to supply gas through valve 82, powder feeder 84 and line 86 to the powder injector nozzle 88. The powder feeder 84 is a conventional commercially available device. One particular model which may be used in the practice of this invention is a powder feeder manufactured by Plasmadyne of California. It is equipped with a canister on top that holds the powder. A wheel at the bottom of the canister rotates to feed powder into the powder feed hose. The canister gas is fed into the top of the canister where the powder and carrier gas are mixed. The powder is then carried by the carrier gas from the powder feeder along the line 86 to the powder injector 88.

In general, the practice of the method of the present invention involves the provision for selection of a sheet of superalloy as a receiving sheet. The sheet provided may be one of René 41 or a similar superalloy in sheet form. Preferably, in order to minimize the bulk and weight of the part to be formed a relatively thin sheet is selected. A sheet having thickness dimension of approximately 0.02" is suitable.

Preferably, such a sheet is then coiled into a tube in preparation for insertion into a low pressure plasma deposition apparatus such as that illustrated in FIG. 1 or FIG. 2. The coiled sheet is made a target, such as target 34 of FIG. 1 or target 78 of FIG. 2. Means are provided within the evacuated chamber where the coiled sheet is disposed to induce a rotation of the coiled sheet on its tubular axis. In this way, the plasma flame plays on different surfaces of the different portions of the surface of the sheet as the tube is rotated.

To secure the sheet in its coiled position and facilitate manipulation and rotation, it can be mounted on a drum. For convenience, it is preferably fastened to such a drum in any suitable conventional fashion.

Figure 3:
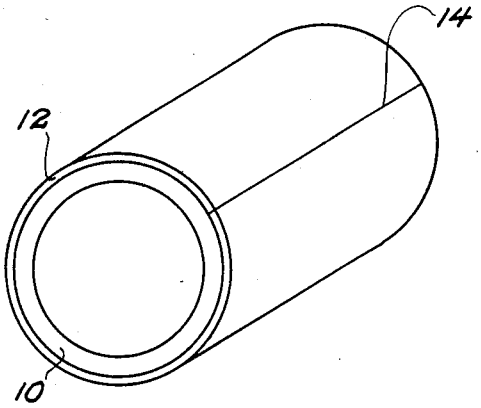
FIG. 3 is a schematic perspective view of a mandrel with a preformed sheet wrapped therearound.

The manner of carrying out the present invention is schematically illustrated in the accompanying figures. Referring first to FIG. 3, a heavy walled drum 10 having actual dimensions of about $\frac{1}{8}$" thickness is provided. The mandrel can be formed from $\frac{1}{8}$" thick sheet material or otherwise.

A preformed sheet of René 41 material of the thickness of 0.02" 12 is wrapped around the drum 10 and clamped to the mandrel by any suitable clamping means which may be mounted over the seam 14 at which the two ends of the sheet are butted together.

Figure 4:
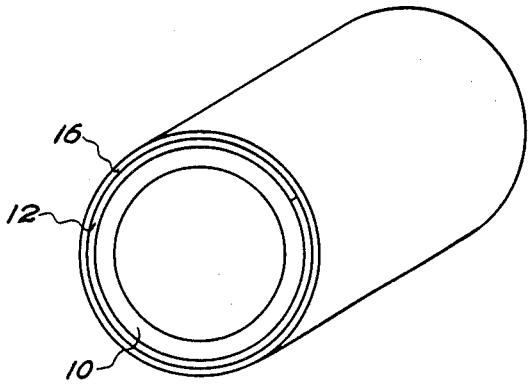
FIG. 4 is a schematic illustration of the article of FIG. 3 on which an external layer has been deposited.

The drum and wrapped sheet of FIG. 3 are introduced into an apparatus as illustrated in FIGS. 1 and 2 and a deposit of superalloy powder is formed on the preformed sheet 12 by the low pressure plasma deposition process to form a thin composite sheet. Such a deposit 16 is formed over the preformed sheet 12 as illustrated in FIG. 4. The resultant sheet 16 is deposited over the preformed inner sheet 12 and is very firmly bonded to the surface of sheet 12 to comprise a thin composite sheet.

Figure 5:
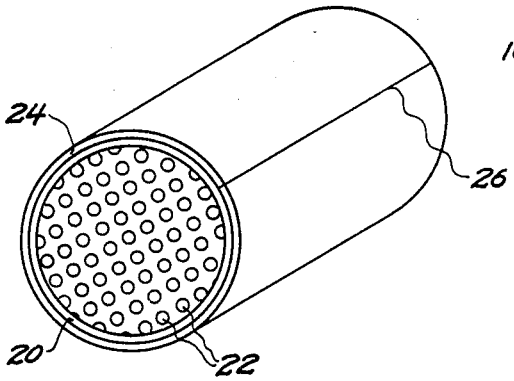
FIG. 5 is a schematic illustration of a superalloy sheet mounted on a lighter bulk mandrel.

Referring next to FIG. 5, a schematic illustration of a lighter wall drum 20 is presented in essentially the same configuration as drum 10 of FIG. 3. The drum 20 not only has a thinner wall of perhaps 0.06" but also has perforations 22 which make the drum even lighter for easier heating.

A strip or sheet 24 of a superalloy is then mounted on drum 20 to expose the seam 26 where the two ends are butted.

Figure 6:
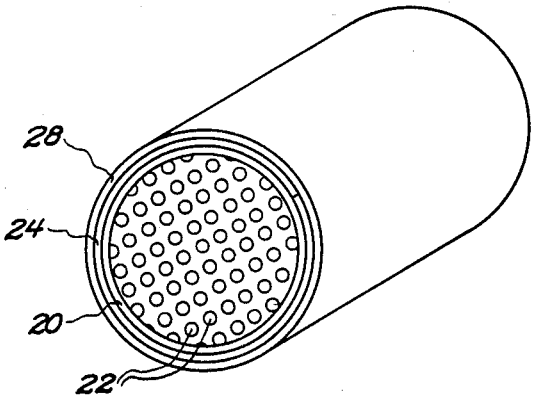
FIG. 6 is esentially the article of FIG. 5 on which an external layer has been formed.

The apparatus of FIG. 5 is introduced into a low pressure plasma deposition apparatus as illustrated in FIGS. 1 and 2 and is subjected to the plasma deposition process to form an outer layer 28 of a superalloy thereon. The plasma formed layer 28 is illustrated in FIG. 6.

The coiled sheet or tube is then coated in the plasma apparatus as illustrated in FIG. 1 or FIG. 2. A deposit of a superalloy such as René 80 superalloy can be in this way formed on the surface of the preformed sheet. Where a mandrel is used, a relatively lighter weight mandrel is preferred in order to avoid having excessive heat sink in the mandrel, thus requiring very high levels of heat to be put through the preformed sheet coiled on the mandrel in order to heat the mandrel and superposed sheet to a temperature at which the sheet will conveniently accept and retain plasma deposited spray.

Some details of the process of the present invention will be made clear by reference to the accompanying examples.

EXAMPLE 1

A strip of René 41 sheet having a thickness of 0.02" was wrapped around an 8" diameter, 5" wide, cylindrical drum as illustrated in FIG. 3. The sheet was fastened to the drum. The drum with its mounted sheet was introduced into a low pressure plasma deposition apparatus as described with reference to FIGS. 1 and 2 and the René 41 sheet was then spray coated with René 80 superalloy. The superalloy is supplied as a powder to a gun as described with reference to FIG. 1 or an injection nozzle such as 88 as described with reference to FIG. 2. The powder is plasma spray deposited on the René 41 substrate to form a layer of about 0.020" on the substrate.

The formed sheet and drum are allowed to cool and are then removed from the LPPD (low pressure plasma deposition) chamber. After removal from the chamber, the bimetal sheet is separated from the drum and straightened by various means. The straightened sheet may be heat treated and rolled and annealed to yield a flat bimetal sheet of a desired thickness.

During the low pressure plasma deposition the drum and sheet, having a form as schematically illustrated in FIG. 3, are preheated with the flame of the plasma prior to the introduction of the powder into the flame to deposit the René 80 layer on the preformed sheet.

In attempting to form the product as described above, a first attempt was made to provide a drum mandrel on which the preformed sheet could be mounted and sprayed. For this purpose, an 8" diameter drum was fabricated from 0.125" wall thickness steel sheet. Trial spray runs using the relatively heavy walled drum required a great deal of torch, plasma flame preheating and reverse transferred arc cleaning.

The mandrel was wrapped with the strip of 0.02" thick René 41 metal sheet. The applied sheet 12 and mandrel were then plasma heated and a deposit of René 80 metal was plasma applied. Microstructural evaluation of the material fabricated using this scheme revealed an incipient melting of the wrought René 41 sheet had occurred. This incipient melting occurred presumably because of overheating of the thin sheet metal in order to transfer sufficient heat to the heavy walled drum to bring it to a temperature where a deposit could be made on the René 41 preformed sheet.

EXAMPLE 2

Subsequently, attempts to fabricate the bimetal product of this invention used a drum made from perforated sheet metal with a wall thickness of 0.062". This second drum illustrated schematically in FIG. 5, had a much lower mass both because of its relative thinness and also because of the perforations and permitted the drum to be brought to a suitable temperature for plasma deposition with more gentle preheating and transferred arc cleaning. All of the samples prepared using the low mass drum showed no evidence of incipient melting.

EXAMPLE 3

After fabrication of the as-sprayed bimetal sheet as described in Example 2, it was heat treated for one hour at 1240° C. in a retort under an argon atmosphere. Following this heat treatment the bimetal sheet still had the approximate shape of the cylinder on which it had been mounted during plasma spraying and therefore it required straightening.

A three roll straightening process was used to flatten the generally tubular sheet and to uncoil it and to form it into a nearly flat condition.

After straightening, the flat sheet could be rolled in a four high Farrell mill to further straighten the sheet and to roll out as much of the plasma sprayed surface roughness as desired.

In order to remove the cold work of the rolling operation the bimetal sheet was annealed at 1225° C. for one hour in an argon atmosphere while between two heavy plates. The resulting sheet was observed to be fully annealed and nearly completely flat.

Subsequently, a test of the product sheet formed as described above showed that the fully annealed sheet material could be bent around a ⅛" radius of curvature without cracking of the René 41 layer or of the René 80 layer.

What is claimed and sought to be protected by Letters Patent of the United States is as follows:

1. A method of forming a generally planar component of a jet engine which comprises, providing a preformed sheet of a superalloy, coiling the sheet into a tube, plasma spraying a layer of a superalloy onto said preformed sheet while in the form of a tube, uncoiling the preformed sheet with the superalloy deposit, and forming the uncoiled sheet into said generally planar component.

2. The method of claim 1 in which the preformed sheet is of René 41 superalloy.

3. The method of claim 1 in which the plasma sprayed layer is of René 80 superalloy.

4. The method of claim 1 in which the preformed sheet is wrapped around a cylindrical drum.

5. The method of claim 2 in which the sheet is about 0.02 inches in thickness.

6. The method of claim 3 in which the deposit is about 0.02 inches in thickness.

7. The method of claim 1 in which the resultant sheet is about 0.04 inches in thickness.

8. The method of claim 1 in which two different superalloys are employed to form a bimetal sheet.

9. The method of claim 1 in which the forming of the uncoiled sheet is by reverse rolling to flatten the product sheet.

* * * * *